US007179110B1

(12) United States Patent
Huang

(10) Patent No.: US 7,179,110 B1
(45) Date of Patent: Feb. 20, 2007

(54) STABLY FASTENED SAFETY PLUG

(76) Inventor: Chia-Hung Huang, 2F-1, No. 111, Ho-Ping East Road, Sec. 3, Taipei (TW)

( * ) Notice: Subject to any disclaimer, the term of this patent is extended or adjusted under 35 U.S.C. 154(b) by 0 days.

(21) Appl. No.: 11/447,757

(22) Filed: Jun. 7, 2006

(51) Int. Cl.
*H01R 4/50* (2006.01)
*H01R 13/625* (2006.01)

(52) U.S. Cl. ..... 439/346; 439/381

(58) Field of Classification Search ..... 439/346, 439/381, 889
See application file for complete search history.

(56) References Cited

U.S. PATENT DOCUMENTS 2,447,597 A * 8/1948 Reed ..... 439/536
2,479,234 A * 8/1949 Hammerly et al. ..... 439/346
2,850,711 A * 9/1958 Terlinde ..... 439/269.2
3,159,445 A * 12/1964 Wolk ..... 439/269.2
5,630,726 A * 5/1997 Baldwin ..... 439/346
5,921,799 A * 7/1999 Forrester ..... 439/346
6,875,040 B1 * 4/2005 O'Keefe et al. ..... 439/346
2004/0102103 A1 * 5/2004 Kling et al. ..... 439/692
2004/0235334 A1 * 11/2004 Kim ..... 439/381

* cited by examiner

*Primary Examiner*—Tulsidas C. Patel
*Assistant Examiner*—Vladimir Imas

(57) ABSTRACT

A safety plug includes a pair of prongs each prong having a hook portion formed on an end portion of the prong to be locked or engaged with a fastening loop portion formed in a receptacle when plugged in the receptacle to prevent from unexpected withdrawal of the safety plug from the receptacle for enhancing electrical safety and for maintaining a normal power supply to an electric equipment.

8 Claims, 5 Drawing Sheets

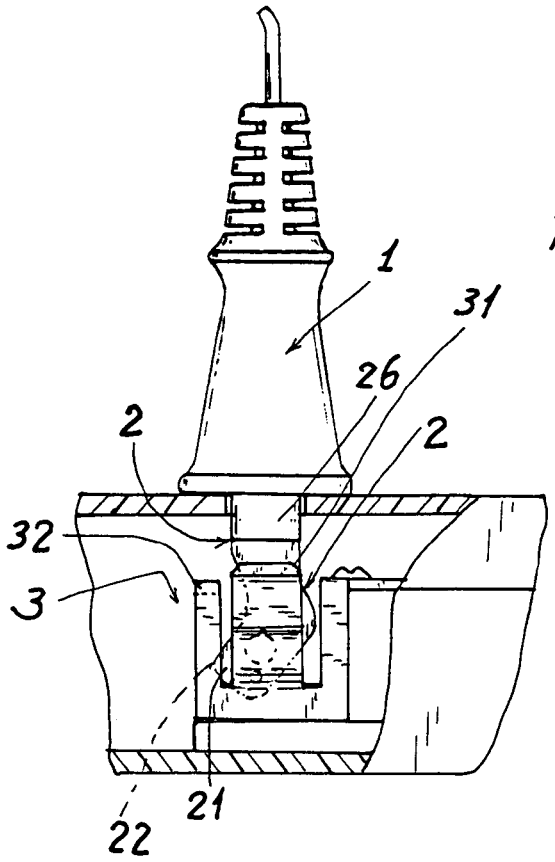
Fig. 4
Fig.5
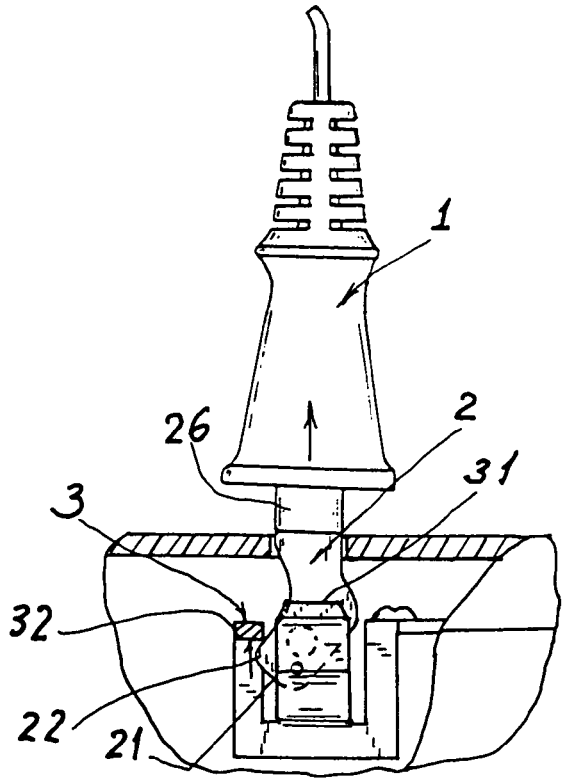

STABLY FASTENED SAFETY PLUG

BACKGROUND OF THE INVENTION

A conventional electrical plug has its two prongs inserted into a receptacle for power connection. However, the prongs, when loosely pulled outwardly from the receptacle, may cause electric shock or injury when electrically conducted to a person or a child.

U.S. Pat. No. 5,252,082 disclosed a safety plug having its two prongs shielded by a casing during plugging operation of the plug. Such a casing may prevent the prongs from being contacted by a person or a child for safety purpose. However, when using such a plug, the casing for shielding the prongs may obstruct the normal plugging operation, thereby causing inconvenience use of the safety plug.

The present inventor has found the drawbacks of the conventional electric plug or safety plug and invented the present safety plug as stably fastened in a receptacle.

SUMMARY OF THE INVENTION

The object of the present invention is to provide a safety plug including a pair of prongs each prong having a hook portion formed on an end portion of the prong to be locked or engaged with a fastening loop portion formed in a receptacle when plugged in the receptacle to prevent from unexpected withdrawal of the safety plug from the receptacle for enhancing electrical safety.

BRIEF DESCRIPTION OF THE DRAWINGS

FIG. 4 shows another receptacle for clamping the plug prongs of the present invention.

FIG. 5 shows the fastening of the plug prong with a loop portion of the receptacle.

DETAILED DESCRIPTION

Figure 1:
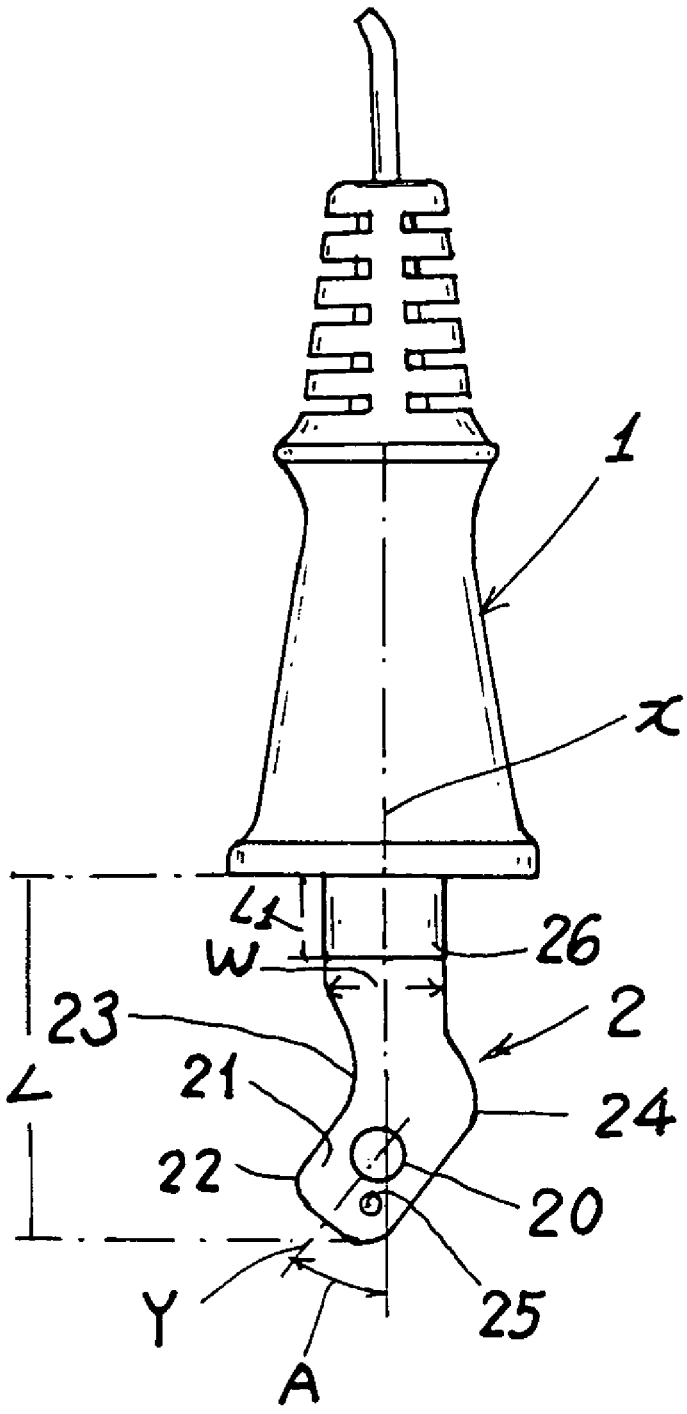
FIG. 1 is a side view illustration of the present invention.
Figure 2:
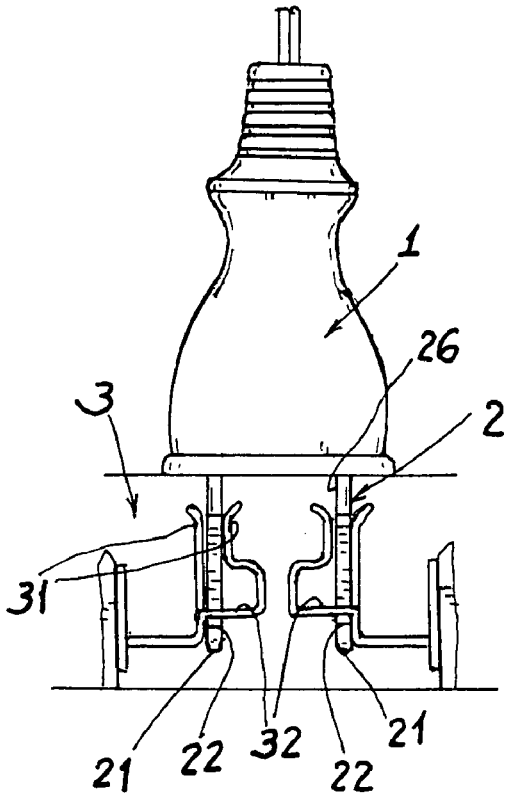
FIG. 2 is a front view illustration of the present invention when inserted in a receptacle.
Figure 3:
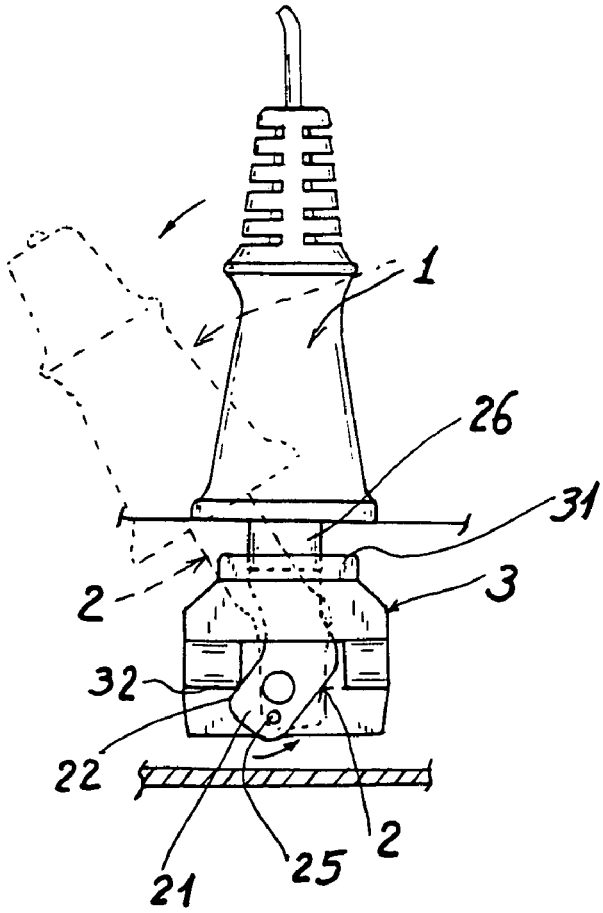
FIG. 3 is another illustration showing the fastening of the prong in the receptacle in accordance with the present invention.
Figure 6:
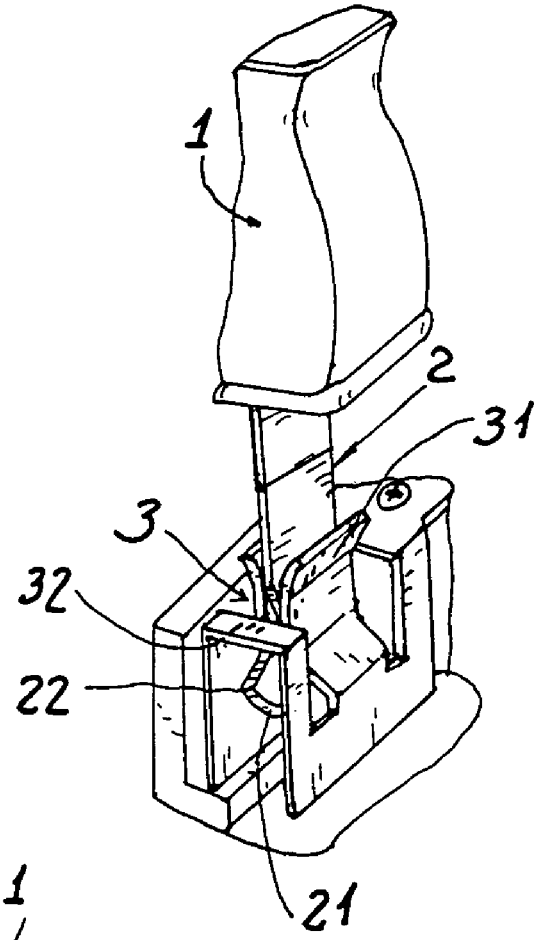
FIG. 6 is a perspective view of the present invention as shown in FIG. 5.

As shown in FIGS. 1~3, the safety plug of the present invention comprises: a plug body 1, a pair of prongs 2 protruding outwardly from the plug body 1 to be plugged or inserted into a receptacle or socket 3 for connecting electric power or power supply.

Each prong 2 is protruded outwardly linearly from the plug body 1 along a longitudinal axis X defined at a longitudinal center of the prong 2, a hook portion 21 inclinedly formed on the prong 2 along a short axis Y defined at a longitudinal center of said hook portion 21 and deviated from the longitudinal axis X of the prong 2 at an acute angle A as measured at a distal end of the prong 2.

The hook portion 21 is protruded sidewardly beyond a width W (or contour) of the prong 2 to form a hook end 22 at an outer end portion of the prong 2 to be engaged or locked with a fastening loop portion 32 adjacent to a clip 31 in a receptacle 3.

The prong 2 is formed with a recess portion 23 adjacent to the hook end 22 so as to help the hook portion 21 to be smoothly engaged with (or disengaged from) the fastening loop portion 32 in the receptacle 3.

Figure 8:
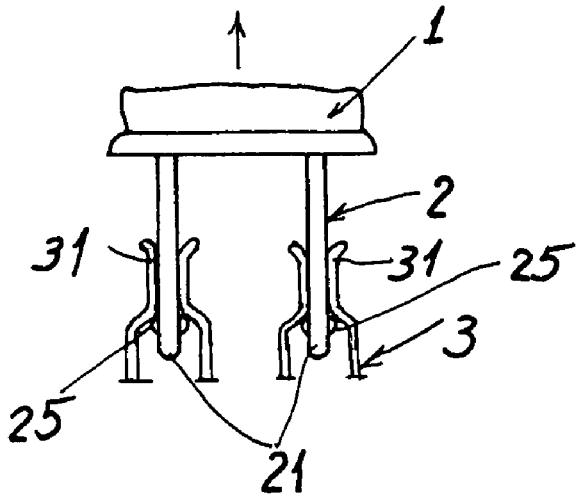
FIG. 8 shows the protrusions formed on the prongs of the present invention as frictionally retarded by the clips of the receptacle.

The prong 2 may further include at least a protrusion 25 formed on an outer end portion of the prong 2 adjacent to the prong hole 20 so as to increase the friction between the prong 2 and the clip 31 of the receptacle 3 as shown in FIG. 8 so that the plug may not be easily withdrawn especially by a child for ensuring electric safety.

The protrusion 25 may be formed as a ball, a point, an arcuate linear extension, or a sloping surface portion to be frictionally retained in between the clip 31 and the prong 2 (FIG. 8) to prevent from unexpected removal of the plug from the receptacle. However, the prong 2 may be forcibly removed, once not for use, from the receptacle, not being deadly locked in the receptacle.

Each prong 2 further includes an insulating layer (or coating or sleeve) 26 covering a root portion of the prong 2 to prevent from electrical conductance and electric shock accident when partially pulling the plug outwardly from the receptacle. However, the insulating layer 26 may have a length L1 which is equal to (or less than) one third of the length L of the prong 2.

Otherwise, if the insulating layer 26 is formed to be too long, the longer insulating layer 26 may influence the normal power connection since it may insulate the prong to interrupt its normal electrical conductance.

When plugging the present invention in the receptacle 3, the hook portion 21 will be locked by the fastening loop portion 32 adjacent to the clip 31. For withdrawing the plug from the receptacle, the prong and plug is tilted to disengage the hook portion 21 from the fastening loop portion 32 as dotted line shown in FIG. 3, thereby "unlocking" the plug from the receptacle smoothly.

As shown in FIGS. 4~7, the receptacle 3 includes a fastening loop portion 32 which is formed as an inversed U shape for locking or engaging the hook end 22 of the prong 3 to prevent from unexpected withdrawal of the prong from the receptacle.

Figure 7:
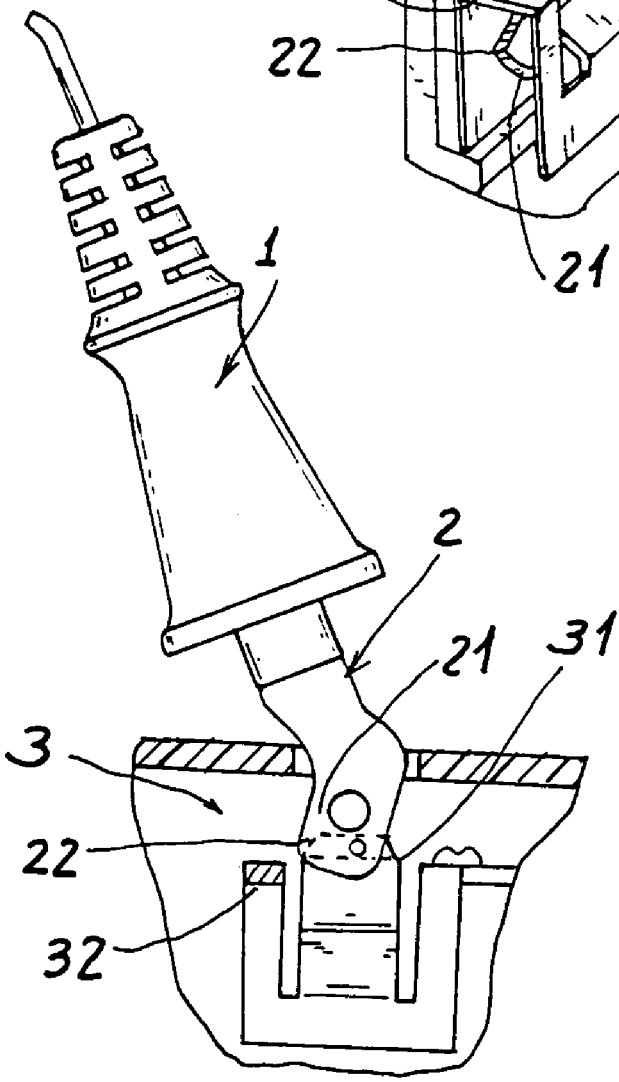
FIG. 7 is an illustration when removing the prongs from the receptacle.

For withdrawal of the plug from the receptacle 3, the prong 2 may be tilted as shown in FIG. 7 to disengage the hook portion 21 of the prong 2 from the fastening loop portion 32 of the receptacle 3.

So, when plugging the prong into the receptacle 3 or removing the prong from the receptacle 3, the plug and prong may be slightly tilted in order to pass the prong opening (or slot) formed through a cover of the receptacle.

Figure 9:
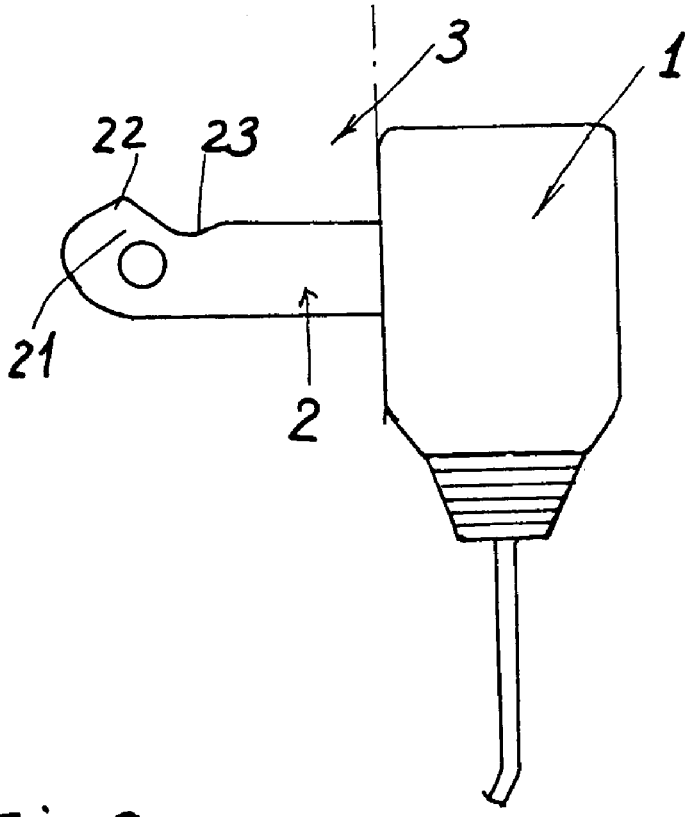
FIG. 9 shows another preferred embodiment of the present invention.

As shown in FIG. 9, another preferred embodiment of the present invention is presented to modify the prong 2 to be perpendicular to the plug body 1 and the aforementioned extension portion 24 opposite to the recess portion 23 and the protrusion 25 may then be eliminated.

The present invention is superior to the conventional plug or prior art with the following advantages:

1. Without implementation of any complex locking mechanism, just by forming a hook portion 21 on the prong end portion, the prong 2 may then be stably fastened or locked in a receptacle for forming a reliable safety plug.
2. Even the prong 2 is partially pulled outwardly from the receptacle 3, the insulating layer 26 on the prong may still shield the prong from being electrically conducted, thereby enhancing the electrical safety.

3. The protrusion (or protrusions) 25 formed on the prong 2 may help increase the friction between the prong 2 and the clip 31 of the receptacle 3 to increase the difficulty of unexpected withdrawal of the plug from the receptacle (such as by a child).

4. The hook portion 21 in cooperation with the recess portion 23 and the extension portion 24 will play like a S-shaped spring to absorb any vibrational shock caused when accidentally or intentionally pulling an electric cord connected with the plug of the present invention, thereby ensuring a reliable plugging of the plug with the receptacle for a reliable continuous power supply.

The present invention may be further modified without departing from the spirit and scope of the present invention.

I claim:

1. A safety plug comprising:

a plug body; and a pair of prongs each said prong protruding outwardly from said plug body along a longitudinal axis defined at a longitudinal center of said prong; each said prong having a hook portion inclinedly formed on an outer end portion of said prong along a short axis defined at a longitudinal center of said hook portion and said short axis deviated from the longitudinal axis of the prong at an acute angle as measured at a distal end of the prong; whereby upon plugging of said prong in a receptacle to be clamped by a clip in said receptacle, said hook portion of said prong is lockable on a fastening loop portion adjacent to said clip in said receptacle to prevent from unexpected withdrawal of the plug from the receptacle for enhancing electrical safety.

2. A safety plug according to claim 1, wherein said hook portion includes a hook end operatively engaged with said fastening loop portion in said receptacle.

3. A safety plug according to claim 1, wherein said prong includes a recess portion formed in said prong adjacent to said hook portion.

4. A safety plug according to claim 3, wherein said prong further includes an extension portion formed on said prong opposite to said recess portion.

5. A safety plug according to claim 1, wherein said hook portion is protruded sidewardly beyond a contour of said prong.

6. A safety plug according to claim 1, wherein said prong includes an insulating layer covered on a root portion of said prong adjacent to the plug body to prevent from electrical conductance when contacted with said prong.

7. A safety plug according to claim 6, wherein said insulating layer has a length being less than one third of a total length of said prong.

8. A safety plug according to claim 1, wherein said prong further includes at least a protrusion formed on an outer end portion of said prong to increase a friction between said prong and said clip of said receptacle to increase the difficulty of unexpected removal of the prong from the receptacle.

* * * * *